US012186650B2

(12) United States Patent
Carville

(10) Patent No.: US 12,186,650 B2
(45) Date of Patent: Jan. 7, 2025

(54) BILLIARDS CHALK HOLDER

(71) Applicant: Randy William Carville, London (CA)

(72) Inventor: Randy William Carville, London (CA)

( * ) Notice: Subject to any disclaimer, the term of this patent is extended or adjusted under 35 U.S.C. 154(b) by 31 days.

(21) Appl. No.: 17/819,937

(22) Filed: Aug. 15, 2022

(65) Prior Publication Data

US 2024/0050839 A1 Feb. 15, 2024

(51) Int. Cl.
*A63D 15/16* (2006.01)

(52) U.S. Cl.
CPC ..... *A63D 15/16* (2013.01)

(58) Field of Classification Search
CPC ..... A63D 15/16
USPC ..... 473/35
See application file for complete search history.

(56) References Cited

U.S. PATENT DOCUMENTS 552,171 A * 12/1895 Roberts ..... A41D 13/082 473/36
601,779 A * 4/1898 Farnham ..... A63D 15/16 473/36
5,328,411 A * 7/1994 Thornton, II ..... A63D 15/16 473/39
10,029,169 B2 * 7/2018 Jimenez ..... A63D 15/16 473/36
10,285,643 B2 * 5/2019 Perkins ..... A61B 5/681
2024/0050839 A1 * 2/2024 Carville ..... A63D 15/16 473/36

* cited by examiner

*Primary Examiner* — Mitra Aryanpour
(74) *Attorney, Agent, or Firm* — Orin Del Vecchio

(57) ABSTRACT

A billiards chalk holder that is configured to be worn on a user's wrist wherein the present invention is designed to have a chalk cube releasably secured thereto so as to be accessible to a user of the present invention during playing of a game of billiards. The present invention includes a strap member having a first end and second end that is configured to be surroundably mounted to a user's wrist. The strap member is operably coupled to opposing sides of a securing member wherein the securing member is annular in shape. The securing member includes an upper surface that can be provided with a portion thereof that is ferromagnetic, have a ferromagnetic material embedded therein or have the entire upper surface manufactured from a ferromagnetic material. A billiards chalk cube having an embedded ferromagnetic layer is provided and configured to be releasably coupled to the securing member.

7 Claims, 3 Drawing Sheets

BILLIARDS CHALK HOLDER

FIELD OF THE INVENTION

The present invention relates generally to billiards accessories, more specifically but not by way of limitation, a billiards chalk holder wherein the chalk holder of the present invention is configured to be worn on a user's wrist and wherein the present invention is configured to have a billiards chalk cube releasably secured thereto.

BACKGROUND

Billiards is a popular sport across the world and is played by millions every year. There are many different types of games that can be played with a conventional billiard setup but regardless of the game all of the games utilize a pool cue and a set of billiard balls. The modern billiard chalk was invented by Pro straight rail player William A. Spinks and chemist William Hoskins back in 1897. They worked together and came up with the perfect mix of silica, aluminum oxide, dye and glue. Spinks and Hoskins found that when adding chalk to their cue-tip it would increase adhesion and decrease cue slip on the ball, Even though pool chalk comes in various brands and different colors, it mostly comprises the same chemical composition, silica, which is mixed with a combination of aluminum oxide and corundum. The reason chalk is applied to a cue stick is that it adds friction. Chalk adds motion-resistance or friction between the cue and the spot where it hits the cue ball. This prevents the cue from sliding off the ball prematurely, ruining the shot, commonly referred to as a miscue. Over time, the tip of a pool stick becomes worn and smooth from use. Chalk provides the friction necessary to make a shot. Another less-direct advantage to chalking up is that it forces the player to pace him or herself and spend a little extra time focusing and concentrating between shots.

Players will frequently apply chalk to the pool cue tip during a game of pool. Often the chalk cubes are located either on the side of the pool table or nearby on a rack or other suitable surface. Generally, players chalk up after every other shot. Also, if a player is considering a shot that requires some extra spin on the ball, the player will chalk up right before that shot, as the smaller amount of surface area used on both the cue tip and the ball requires additional friction. The typical location of the chalk may not be advantageous to the player and as such the player may not chalk as frequently as they should. Additionally, having to traverse to the location of the chalk can have a negative impact on the mental aspect of a player's game.

Accordingly, it is within the scope of the present invention to provide a billiards chalk holder that is configured to be worn on a user's wrist and wherein the present invention is further configured to have a chalk cube releasably secured thereto.

SUMMARY OF THE INVENTION

It is the object of the present invention to provide a billiards chalk cube holder that is configured to be worn on a wrist of a user wherein the present invention includes a strap member.

Another object of the present invention is to provide a holder for a billiards chalk cube that is worn on a user's wrist and configured to have a chalk cube releasably secured thereto wherein the present invention includes a securing member.

A further object of the present invention is to provide a billiards chalk cube holder that is configured to be worn on a wrist of a user wherein the securing member has opposing ends of the strap member secured on opposite sides thereof.

Still another object of the present invention is to provide a holder for a billiards chalk cube that is worn on a user's wrist and configured to have a chalk cube releasably secured thereto wherein the securing member is configured to have either a portion thereof or the entire upper surface thereof manufactured from magnetic material.

An additional object of the present invention is to provide a billiards chalk cube holder that is configured to be worn on a wrist of a user that further includes a chalk cube wherein the chalk cube includes a magnetic material on the bottom thereof.

Yet a further object of the present invention is to a provide a holder for a billiards chalk cube that is worn on a user's wrist and configured to have a chalk cube releasably secured thereto wherein an alternate embodiment includes a chalk cube frame secured to the securing member.

Another object of the present invention is to provide a billiards chalk cube holder that is configured to be worn on a wrist of a user wherein the present invention provides the chalk cube in location so as to remind a player to chalk and further reduces chalk dust on the hands of a player.

To the accomplishment of the above and related objects the present invention may be embodied in the form illustrated in the accompanying drawings. Attention is called to the fact that the drawings are illustrative only. Variations are contemplated as being a part of the present invention, limited only by the scope of the claims.

BRIEF DESCRIPTION OF THE DRAWINGS

A more complete understanding of the present invention may be had by reference to the following Detailed Description and appended claims when taken in conjunction with the accompanying Drawings wherein:

DETAILED DESCRIPTION

Figure 1:
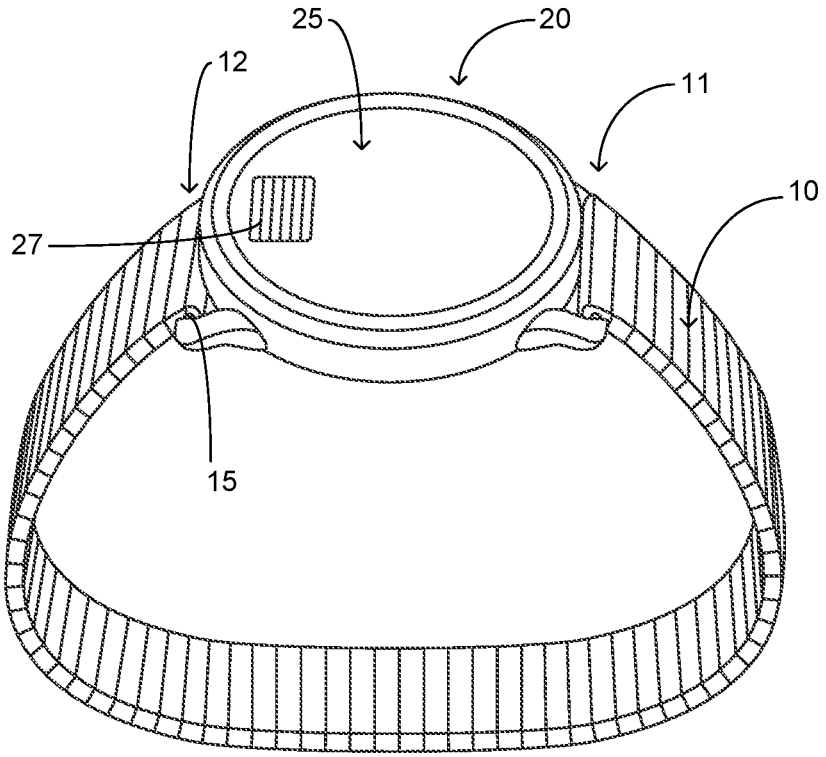
FIG. 1 is a perspective view of an embodiment of the present invention.
Figure 2:
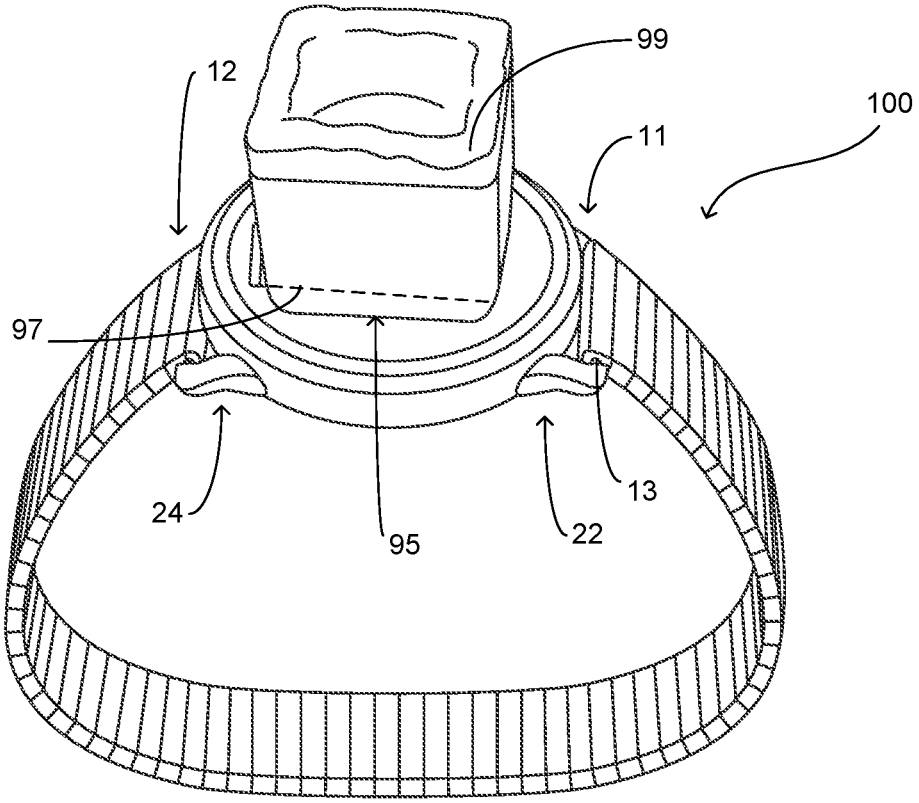
FIG. 2 is a perspective view of an embodiment of the present invention having exemplary chalk releasably secured thereto.

Referring now to the drawings submitted herewith, wherein various elements depicted therein are not necessarily drawn to scale and wherein through the views and figures like elements are referenced with identical reference numerals, there is illustrated a billiards chalk holder 100 constructed according to the principles of the present invention.

An embodiment of the present invention is discussed herein with reference to the figures submitted herewith. Those skilled in the art will understand that the detailed description herein with respect to these figures is for explanatory purposes and that it is contemplated within the scope of the present invention that alternative embodiments are plausible. By way of example but not by way of limitation, those having skill in the art in light of the present teachings of the present invention will recognize a plurality of alternate and suitable approaches dependent upon the needs of the particular application to implement the functionality of any given detail described herein, beyond that of the particular implementation choices in the embodiment described herein. Various modifications and embodiments are within the scope of the present invention.

It is to be further understood that the present invention is not limited to the particular methodology, materials, uses and applications described herein, as these may vary. Furthermore, it is also to be understood that the terminology used herein is used for the purpose of describing particular embodiments only, and is not intended to limit the scope of the present invention. It must be noted that as used herein and in the claims, the singular forms "a", "an" and "the" include the plural reference unless the context clearly dictates otherwise. Thus, for example, a reference to "an element" is a reference to one or more elements and includes equivalents thereof known to those skilled in the art. All conjunctions used are to be understood in the most inclusive sense possible. Thus, the word "or" should be understood as having the definition of a logical "or" rather than that of a logical "exclusive or" unless the context clearly necessitates otherwise. Structures described herein are to be understood also to refer to functional equivalents of such structures. Language that may be construed to express approximation should be so understood unless the context clearly dictates otherwise.

References to "one embodiment", "an embodiment", "exemplary embodiments", and the like may indicate that the embodiment(s) of the invention so described may include a particular feature, structure or characteristic, but not every embodiment necessarily includes the particular feature, structure or characteristic.

Referring in particular to the Figures submitted as a part hereof, the billiards chalk holder 100 includes a strap member 10 wherein the strap member 10 includes a first end 11 and second end 12. The strap member 10 is configured to surroundably mount a user's wrist and releasably secure the billiards chalk holder 100 thereto. It is contemplated within the scope of the present invention that the strap member 10 could be manufactured in various lengths and further be provided in alternate materials such as but not limited to metal or leather. While not particularly illustrated herein, it is contemplated within the scope of the present invention that the strap member 10 could have an adjustment buckle in order to facilitate the securing of the strap member 10 to a user's wrist. The first end 11 and second end 12 include lug receiving apertures 13,15 respectively. As is further discussed herein, the lug receiving apertures 13,15 are configured to have inserted thereinto conventional watch band lugs so as to operably coupled with the securing member 20.

The billiards chalk holder 100 further includes a securing member 20. The securing member 20 is annular in shape being configured to operably couple to strap member 10. The securing member 20 includes lug receivers 22,24 that are diametrically opposed wherein the lug receivers 22,24 are provided in opposing pairs and are configured to facilitate the operable coupling of the first end 11 and second end 12 of the strap member 10 on opposing sides of the securing member 20. While the preferred embodiment utilizes elements to facilitate the coupling of the strap member 10 to the securing member 20 employing conventional watch band lugs, it should be understood within the scope of the present invention that the strap member 10 and securing member 20 could be operably coupled utilizing numerous alternate mechanical elements. While the securing member 20 is illustrated herein as being annular in shape, it should be understood within the scope of the present invention that the securing member 20 could be provided in alternate shapes and sizes. By way of example but not limitation, the securing member 20 could be provided in either a square or rectangular shape.

The securing member 20 includes upper surface 25. The upper surface 25 is suitable in size so as to have a billiards chalk cube 99 superposed thereon. The upper surface 25 includes portion 27 wherein portion 27 is integrally formed with upper surface 25. Portion 27 is manufactured from a ferromagnetic material such as but not limited to nickel or iron. The portion 27 is configured to releasably secure to the bottom 95 of the billiards chalk cube 99 wherein the bottom 95 of the billiards chalk cube 99 has a layer 97 of ferromagnetic material embedded therein. The portion 27 and layer 97 are configured so as to have attracting magnetic forces wherein the magnetic forces are operable to releasably secure the billiards chalk cube 99 to the securing member 20. While magnetic forces and the elements providing the magnetic forces are desired in a preferred embodiment of the present invention, it is contemplated within the scope of the present invention that the billiards chalk holder 100 could be configured with alternate elements in order to facilitate the securing of the billiards chalk cube 99 to the securing member 20. By way of example but not limitation, the billiards chalk holder 100 could employ hook and loop material to facilitate the releasably securing of the billiards chalk cube 99 to the securing member 20. Additionally, it should be further understood within the scope of the present invention that the upper surface 25 could be configured so as the entire surface is manufactured from a ferromagnetic material instead of having portion 27. Furthermore, it is contemplated within the scope of the present invention that the securing member 20 could have a magnetic material embedded therein so as to facilitate an ability to place indicia or other decorative material on the upper surface 25.

Figure 3:
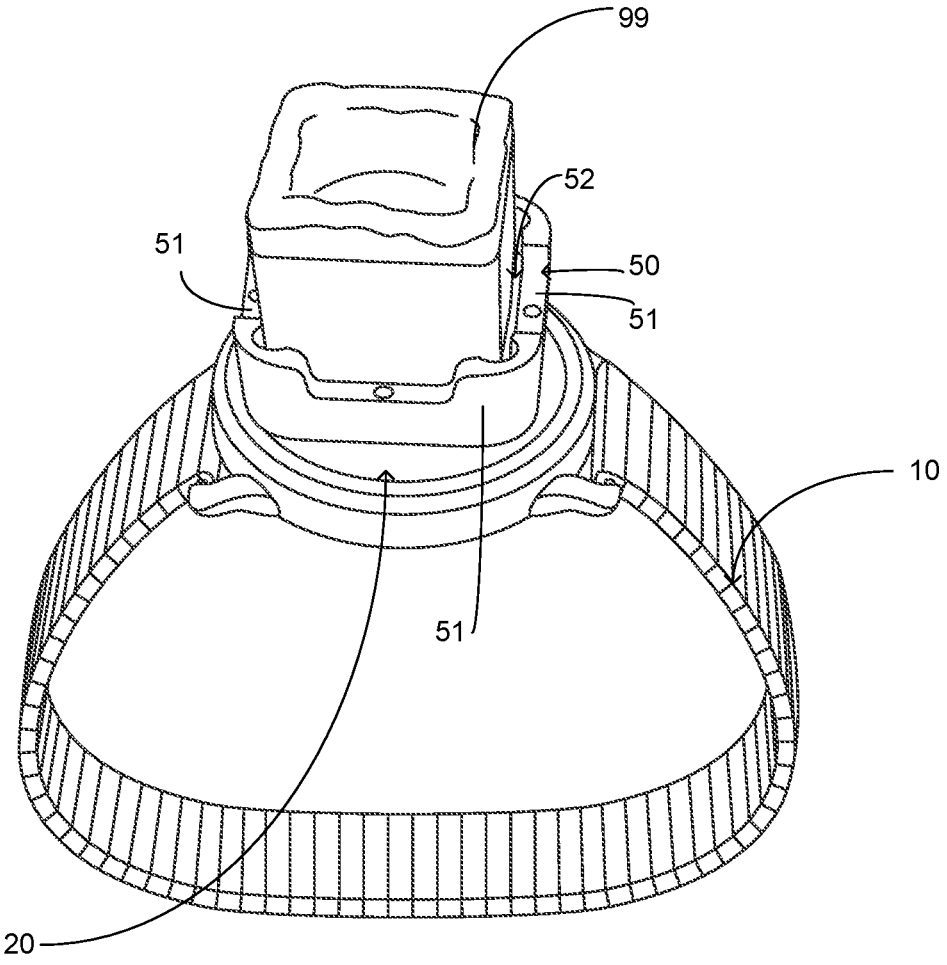
FIG. 3 is a perspective view of an alternative embodiment of the present invention with exemplary chalk releasably secured thereto.
Figure 4:
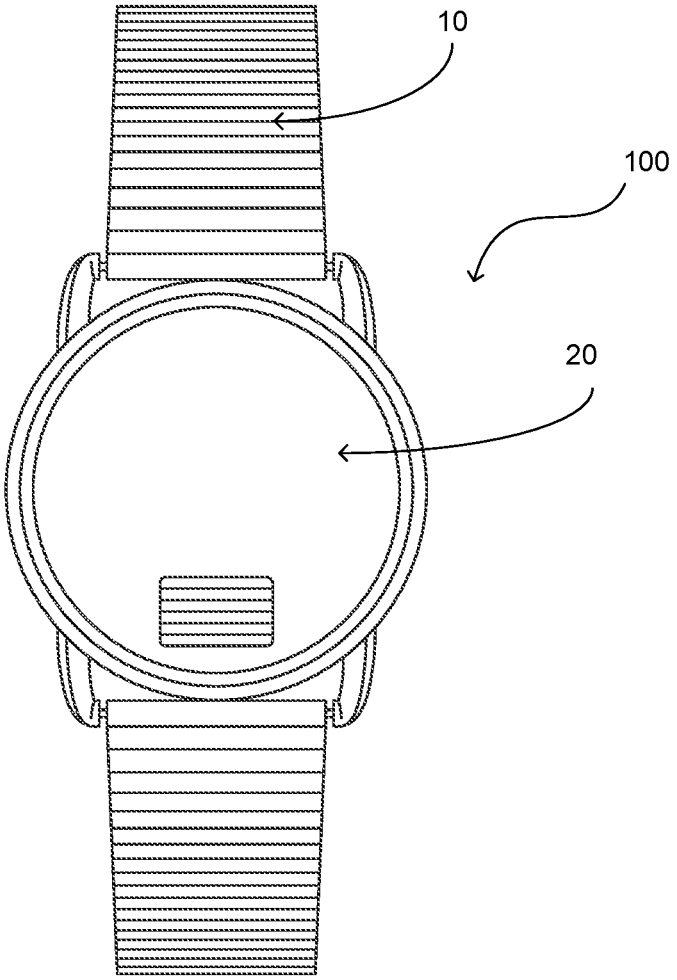
FIG. 4 is a top view of an embodiment of the present invention.

Referring in particular to FIG. 3 submitted herewith, it is contemplated within the scope of the present invention that the billiards chalk holder 100 could alternatively be provided with a chalk cube frame 50. The chalk cube frame 50 is manufactured from a rigid material such as but not limited to metal. The chalk cube frame 50 includes walls 51 wherein walls 51 define an interior volume 52 that is configured to receive a portion of the chalk cube 99 therein. The interior volume 52 is sized and mateably shaped with the chalk cube 99 so as to frictionally engage therewith so as to inhibit movement of the chalk cube 99 ensuing placement within the interior volume 52. The walls 51 and interior volume 52 of the chalk frame 50 provide a structure that inhibits rotational movement of the chalk cube 99 during engagement with a pool cue tip. It is contemplated within the scope of the present invention that the chalk cube frame 50 could either be configured to be mechanically coupled to the securing member 20 or be configured to magnetically secure to the securing member 20. It is contemplated within the scope of the present invention that the height of the walls 51 could be provided in alternate heights. It should be further understood within the scope of the present invention that the chalk cube frame 50 is provided in a mateable shape as the chalk cube 99.

In the preceding detailed description, reference has been made to the accompanying drawings that form a part hereof, and in which are shown by way of illustration specific embodiments in which the invention may be practiced. These embodiments, and certain variants thereof, have been described in sufficient detail to enable those skilled in the art to practice the invention. It is to be understood that other suitable embodiments may be utilized and that logical changes may be made without departing from the spirit or scope of the invention. The description may omit certain information known to those skilled in the art. The preceding detailed description is, therefore, not intended to be limited to the specific forms set forth herein, but on the contrary, it is intended to cover such alternatives, modifications, and equivalents, as can be reasonably included within the spirit and scope of the appended claims.

What is claimed is:

1. A billiards chalk holder that is configured to be releasably secured to a billiards player wherein the billiards chalk holder comprises:

a strap member, said strap member having a first end and a second end, said strap member configured to be circumferentially disposed around a wrist of the billiards player;

a securing member, said securing member being operably coupled to said strap member, said first end of said strap member being secured to a first side of said securing member, said second end of said strap member being secured to a second side of said securing member, said securing member being planar in manner, said securing member having an upper surface, said upper surface having a portion, said portion being manufactured from a ferromagnetic material;

a chalk cube frame, said chalk cube frame being operably coupled to said upper surface of said securing member, said chalk cube frame having embedded therein a second portion of a second ferromagnetic material, said chalk cube frame having a plurality of walls configured to form an interior volume, said interior volume of said chalk cube frame configured to mateably receive a billiards chalk cube and; and wherein said portion is configured to have releasably secured thereto the chalk cube frame via magnetic engagement of the portion and the second portion.

2. The billiards chalk holder that is configured to be releasably secured to a billiards player as recited in claim 1, wherein said first end of said strap member includes lug receiving apertures.

3. The billiards chalk holder that is configured to be releasably secured to a billiards player as recited in claim 2, wherein said portion of said upper surface is embedded underneath said upper surface.

4. The billiards chalk holder that is configured to be releasably secured to a billiards player as recited in claim 3, wherein said second end of said strap member includes lug receiving apertures.

5. The billiards chalk holder that is configured to be releasably secured to a billiards player as recited in claim 4, wherein said first side of said securing member has lug receivers formed thereon, said lug receivers configured to align with the lug receiving apertures on said first end of said strap member.

6. The billiards chalk holder that is configured to be releasably secured to a billiards player as recited in claim 5, wherein said second side of said securing member has lug receivers formed thereon, said lug receivers on said second side of said securing member configured to align with the lug receiving apertures on said second end of said strap member.

7. The billiards chalk holder that is configured to be releasably secured to a billiards player as recited in claim 6, wherein said securing member is annular in shape.

* * * * *